US006571815B1

(12) United States Patent
Hill

(10) Patent No.: US 6,571,815 B1
(45) Date of Patent: Jun. 3, 2003

(54) SUN SHIELD

(76) Inventor: Jimmy Hill, 4480 Old Guernsey Rd., Pace, FL (US) 32571

( * ) Notice: Subject to any disclaimer, the term of this patent is extended or adjusted under 35 U.S.C. 154(b) by 0 days.

(21) Appl. No.: 09/911,645

(22) Filed: Jul. 24, 2001

(51) Int. Cl.[7] ..... E04H 15/58; E04H 15/20

(52) U.S. Cl. ..... 135/96; 135/117; 135/120.4; 52/23; 52/2.25; 244/31

(58) Field of Search ..... 135/96, 117, 115, 135/119, 120.4; 52/2.22, 2.23, 2.24, 2.25, 23, 63, 83–84, 3; 244/31–33; 446/220, 221, 222; 40/214

(56) References Cited

U.S. PATENT DOCUMENTS

| | | | | | |
|---|---|---|---|---|---|
| 2,540,380 | A | * | 2/1951 | Schultheis | 135/115 |
| 2,863,467 | A | | 12/1958 | Flearell | 135/20 |
| 3,169,542 | A | | 2/1965 | Neumark | 135/1 |
| 3,353,309 | A | * | 11/1967 | Kwake | 135/117 |
| 3,389,559 | A | * | 6/1968 | Logan | 137/312 |
| 3,638,368 | A | * | 2/1972 | Pierson | 47/32.1 |
| 3,802,451 | A | | 4/1974 | Morris | 135/203 |
| 4,013,018 | A | | 3/1977 | Hansen et al. | 105/468 |
| 4,257,199 | A | | 3/1981 | Kuboyama | 52/2 |
| 4,497,272 | A | * | 2/1985 | Veazey | 114/102.29 |
| 4,641,400 | A | * | 2/1987 | Moreland | 135/119 |
| 4,643,210 | A | | 2/1987 | Feld | 135/20 B |
| 4,662,127 | A | | 5/1987 | Glode | 52/2 |
| 5,076,029 | A | | 12/1991 | Sevilla | 52/2.24 |
| 5,123,434 | A | | 6/1992 | Fetterly | 135/20.2 |
| 5,226,262 | A | * | 7/1993 | Kelley | 52/63 |
| 5,555,679 | A | * | 9/1996 | Scherba | 135/126 |
| 5,769,105 | A | * | 6/1998 | Margol et al. | 135/119 |

FOREIGN PATENT DOCUMENTS

| | | | | |
|---|---|---|---|---|
| FR | 2701284 | * | 8/1994 | |
| JP | 6-248807 | * | 9/1994 | 52/2.25 |
| RU | 2032053 | * | 5/1990 | |

* cited by examiner

*Primary Examiner*—Lanna Mai
*Assistant Examiner*—Winnie Yip
(74) *Attorney, Agent, or Firm*—Peter Loffler

(57) ABSTRACT

A sun shield uses a canopy that has a plurality of first openings located around its outer periphery and a second centrally located opening. A plurality of first balloons are tethered to the first openings while a second balloon is tethered to a plurality of third openings located about the second opening. Tethers are connected between the first openings and anchors secured to the ground. Clips can be used to secure two canopies together.

13 Claims, 3 Drawing Sheets

SUN SHIELD

BACKGROUND OF THE INVENTION

1. Field of the Invention

The present invention relates to shield that protects people from the sun and other elements and that uses a series of balloons and tie down tethers to keep the shield in place.

2. Background of the Prior Art

Working in the hot sun has a substantial effect on works. Even with proper hydration, workers will tend to slow down as the day progresses due to the heating of the body by direct sunlight. One method workers employ to protect themselves from the heat of direct sunlight is to wear headgear to block the sun from the head of the workers. While effective, this method is only a moderate solution and does little to afford protection to the remainder of a worker's body. Another method used to protect workers from the effects of direct sunlight is to work in shade especially during peak sun periods. Although effective, such a method is limited at best, as many work sites lack adequate shade and some, such as vegetable fields, lack any shade whatsoever.

Yet another method employed by workers is to erect a temporary sun shield that is used to block the rays of the sun and to work under the shield. This method is effective at blocking the sunlight, although it has certain limitations. Some shields are of limited size and therefore can shield only a small area, making such shields relatively ineffective for large scale job sites such as for roofers working on a large shopping center. Other shields cover a relatively large area but such shields are unduly complex in design and construction and are relatively difficult to assemble and use.

Therefore, there is a need in the art for a sun shield that addresses the above-stated problems in the art. Such a sun shield must shield people from the harmful effects of the sun's rays so that the people can either work or play in even the most grueling of sun conditions. The sun shield must be able to cover a relatively large area and must be relatively simple in design and construction and must not be unduly difficult to assemble, disassemble, and use. Ideally, such a sun shield will be aesthetically pleasing.

SUMMARY OF THE INVENTION

The sun shield of the present invention addresses the aforementioned needs in the art. The sun shield shields users from the harmful effects of the sun's rays so that the users can either work or play in the most grueling of sun conditions. The sun shield covers a relatively large area and is expandable as needed. The sun shield of the present invention is of relatively simple design and construction and is relatively simple to assemble, disassemble, and use. The sun shield is aesthetically pleasing.

The sun shield of the present invention is comprised of a canopy having an outer periphery, a plurality of first openings located about the outer periphery, a second opening, and a plurality of third opening located about the second opening. A plurality of first balloons, each having a first tether, are each secured to a respective one of the plurality of first openings. A second balloon has a plurality of second tethers such that each second tether is connected to a respective one of the third openings. A plurality of anchors are adapted to be secured to the ground. A plurality of third tethers are provided such that each third tether is connected to a respective one of the first openings and to a respective one of the anchors. The second balloon is volumetrically larger than each of the plurality of first balloons and is used to keep the central section of the canopy elevated. Each of the first openings is grommetted, while each of the third openings is also grommetted. A plurality of clips are provided such that each clip passes through a respective one of the first openings and passes through a first opening on another sun shield for connecting two canopies together in order to allow stepwise expansion of the device. The clips have a spring-loaded opening.

BRIEF DESCRIPTION OF THE DRAWINGS

Similar reference numerals refer to similar parts throughout the several views of the drawings.

DESCRIPTION OF THE PREFERRED EMBODIMENT

Figure 1:
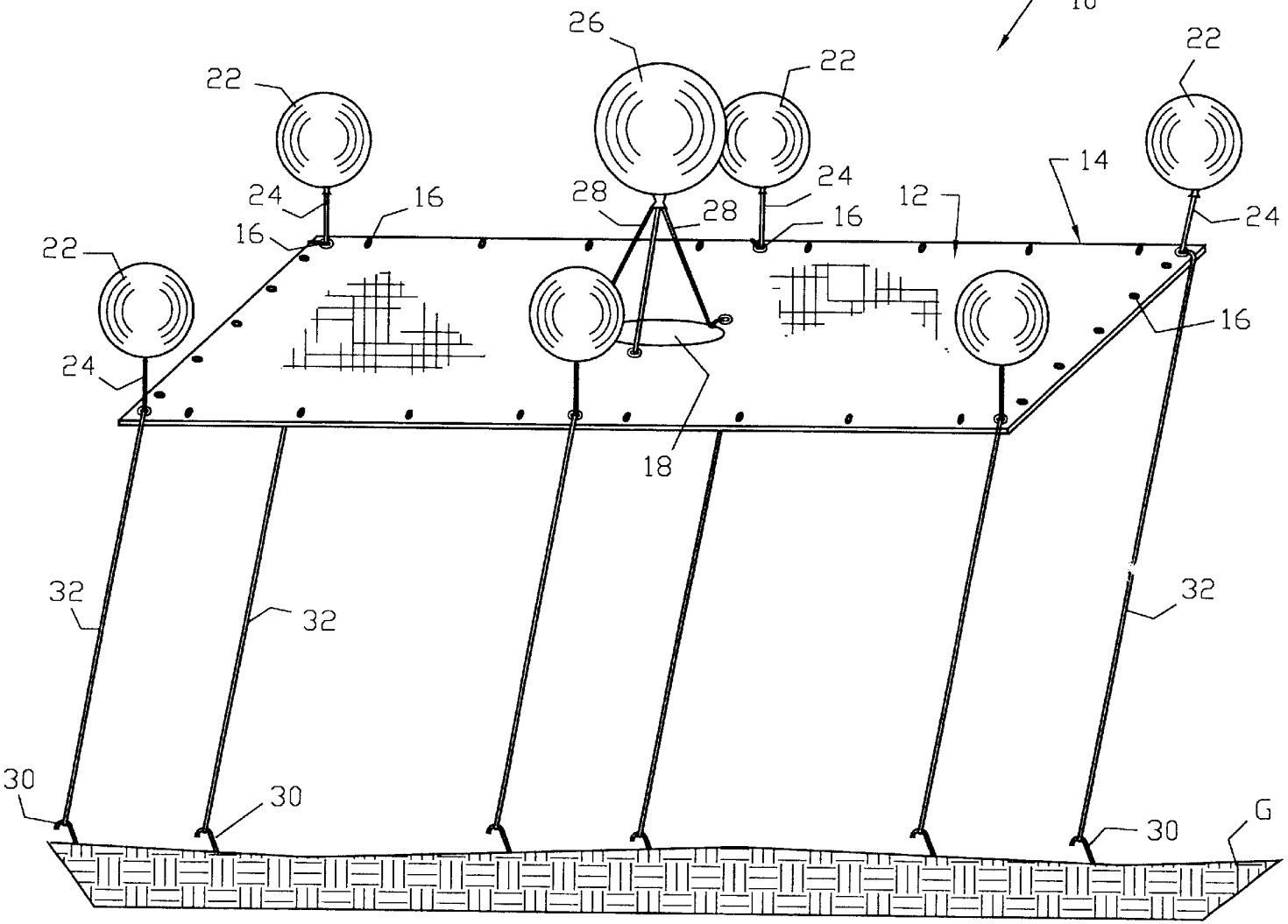
FIG. 1 is a perspective view of the sun shield of the present invention.
Figure 2:
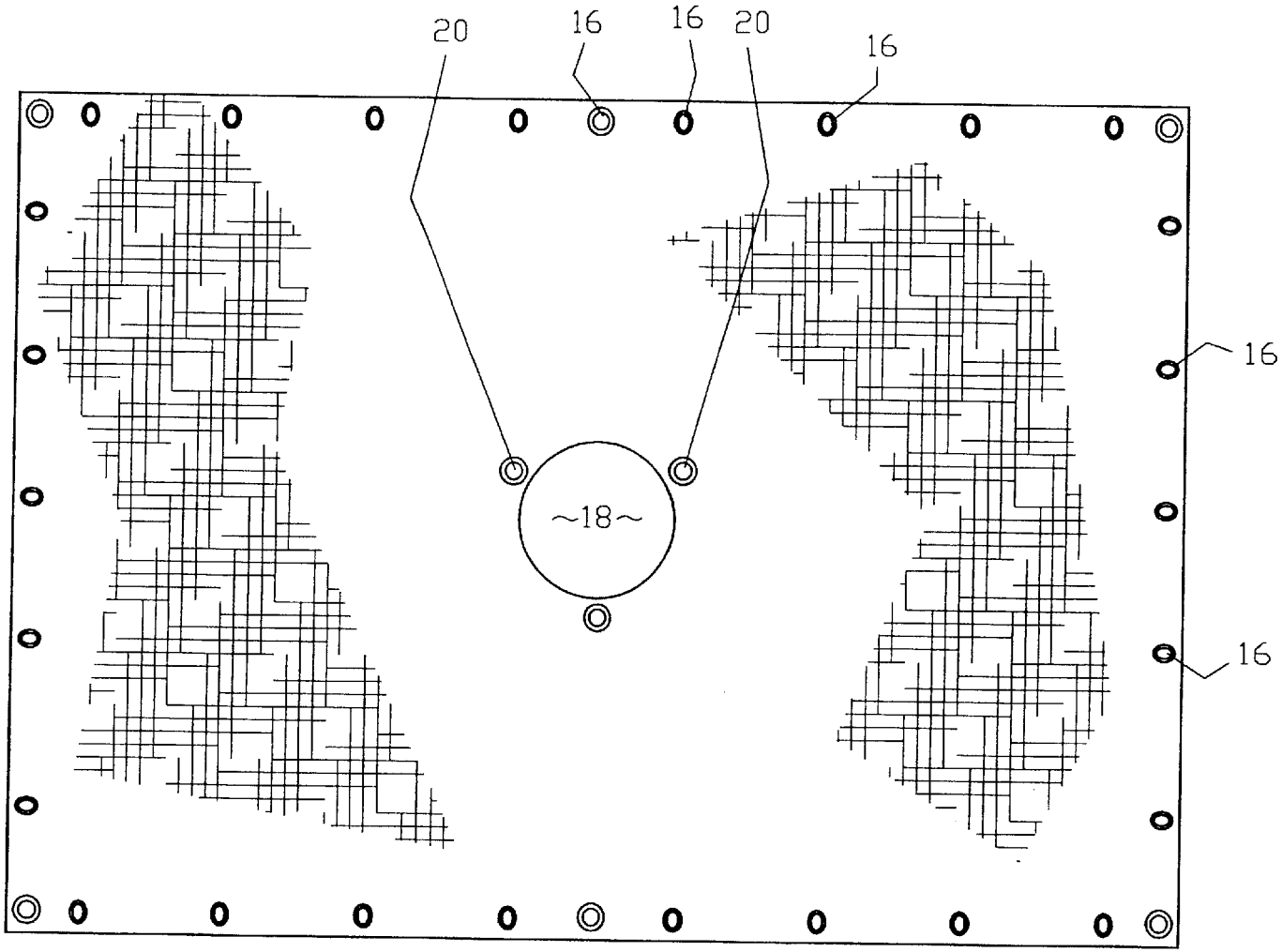
FIG. 2 is a bottom plan view of the sun shield.
Figure 3:
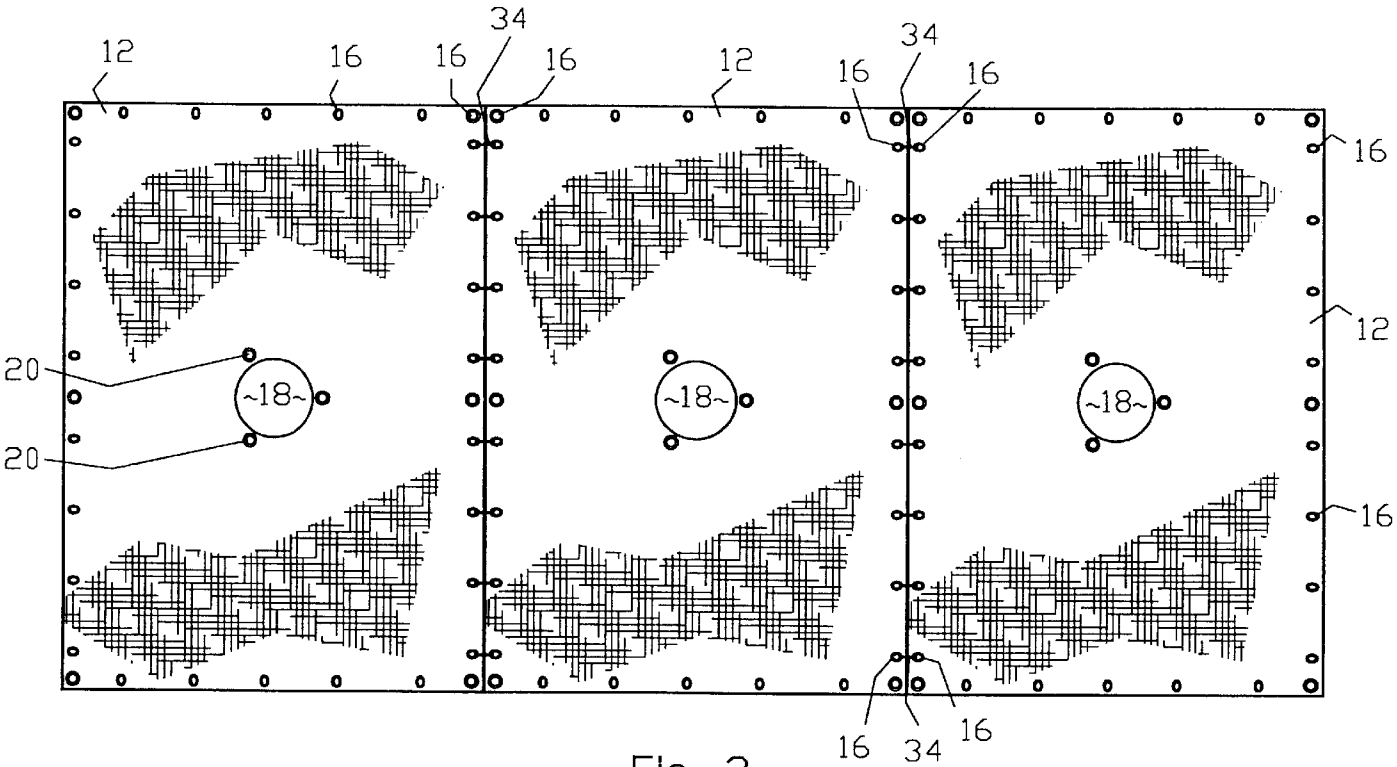
FIG. 3 is a bottom plan view of the sun shield expanded to several shields.
Figure 5:
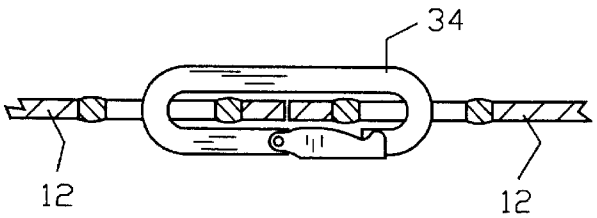
FIG. 5 is a close-up side view of the interconnection of two sun shield canopies.
Figure 4:
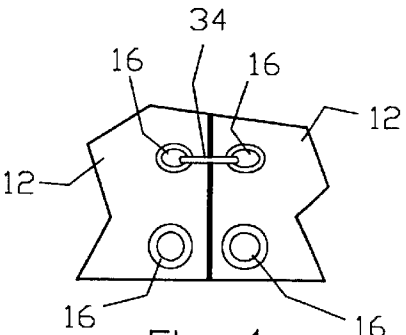
FIG. 4 is a close-up top view of the interconnection of two sun shield canopies.

Referring now to the drawings, it is seen that the sun shield of the present invention, generally denoted by reference numeral 10, is comprised of a canopy 12 having an outer periphery 14, a plurality of first openings 16 located about the outer periphery 14, a second opening 18 centrally located on the canopy 12, and a plurality of third openings 20 located about the second opening 18. A plurality of first balloons 22, each having a first tether 24, are each secured to a respective one of the plurality of first openings 16. A second balloon 26 has a plurality of second tethers 28, such that each second tether 28 is connected to a respective one of the third openings 20. A plurality of anchors 30 are secured to the ground G in any appropriate fashion and can be either removably or fixedly secured thereto. A plurality of third tethers 32 are provided such that each third tether 32 is connected to a respective one of the first openings 16 and to a respective one of the anchors 30. The second balloon 26 is volumetrically larger than each of the plurality of first balloons 22. Each of the first openings 16 is grommetted, while each of the third openings 20 is also grommetted.

In order to use the sun shield 10 of the present invention, the anchors 30 are secured to the ground G in desired fashion. The canopy 12 is tetherly secured to the anchors 30 via the third tethers 32. The first balloons 22 are filled with helium and each is tetherly secured to its respective first opening 16 by the first tethers 24. The second balloon 26 is tetherly secured to the third openings 20 by the second tethers 28. As the canopy 12 rises into position, users can work or play underneath the canopy 12 and are shielded from the sunlight (or other elements) by the canopy 12. The second opening 18, located centrally on the canopy 12, minimizes the effects of wind load on the canopy 12 and helps prevent the canopy 12 from being either torn from the anchors 30 or from being pushed toward the ground G by the wind.

If the sun shield 10 is to be expanded, a plurality of clips 34 are provided such that each clip 34 passes through a respective one of the first openings 16 on the canopy 12 and passes through a first opening 16 on the canopy 12 of another shield 10 for connecting two canopies 12 together. The clips 34 have a spring-loaded opening 36.

While the invention has been particularly shown and described with reference to an embodiment thereof, it will be appreciated by those skilled in the art that various changes in form and detail may be made without departing from the spirit and scope of the invention.

I claim:

1. A shield comprising:

a canopy having an outer periphery, a plurality of first openings located about the outer periphery, a second opening, and a plurality of third opening located about the second opening;

a plurality of first balloons, each attached to a first tether, each first tether secured to a respective one of the plurality of first openings;

a second balloon attached to a plurality of second tethers, each second tether connected to a respective one of one third openings;

a plurality of anchors, each adapted to be secured to the ground;

a plurality of third tethers, each third tether connected to a respective one of the first openings and to a respective one of the anchors; and wherein the plurality of first balloons and the second balloon keep the canopy floating off of the ground in generally parallel orientation to the ground with tethers preventing further ascent of the canopy.

2. The shield as in claim 1 wherein the second balloon is volumetrically larger than each of the plurality of first balloons.

3. The shield as in claim 1 wherein each of the first openings is grommetted.

4. The shield as in claim 3 wherein each of the third openings is grommetted.

5. The shield as in claim 1 wherein each of the third openings is grommetted.

6. The shield as in claim 1 further comprising a plurality of clips, each clip passing through a respective one of the first openings and passing through a first opening on another shield.

7. The shield as in claim 6 wherein the clip has a spring-loaded opening.

8. A shield comprising:

a canopy having an outer periphery and an opening;

a plurality of first tethers, each connected to the outer periphery of the canopy and adapted to be secured to the ground;

a plurality of first balloons secured to the canopy about the outer periphery;

a second balloon secured to the canopy over the opening; and wherein the plurality of first balloons and the second balloon keep the canopy floating off of the ground in generally parallel orientation to the ground with tethers preventing further ascent of the canopy.

9. The shield as in claim 8 wherein the second balloon is volumetrically larger than each of the plurality of first balloons.

10. The shield as in claim 8 wherein each of the first balloons is connected to the canopy by a second tether.

11. The shield as in claim 8 wherein second balloon is connected to the canopy by a plurality of second tethers.

12. The shield as in claim 8 further comprising a plurality of clips, each clip passing through a respective first opening located about the outer periphery and passing through a first opening on another shield.

13. The shield as in claim 12 wherein the clip has a spring-loaded opening.

* * * * *